US007767919B2

(12) United States Patent
Zusman

(10) Patent No.: US 7,767,919 B2
(45) Date of Patent: Aug. 3, 2010

(54) SEALED CONTROL DEVICE WITH MAGNETICALLY ADJUSTABLE CONTROL PARAMETER

(75) Inventor: George Zusman, Houston, TX (US)

(73) Assignee: PCB Piezotronics Inc., Depew, NY (US)

( * ) Notice: Subject to any disclaimer, the term of this patent is extended or adjusted under 35 U.S.C. 154(b) by 841 days.

(21) Appl. No.: 11/703,353

(22) Filed: Feb. 7, 2007

(65) Prior Publication Data

US 2007/0183413 A1 Aug. 9, 2007

Related U.S. Application Data

(60) Provisional application No. 60/771,407, filed on Feb. 8, 2006.

(51) Int. Cl.
*H01H 35/14* (2006.01)

(52) U.S. Cl. ..... 200/61.45 R

(58) Field of Classification Search 200/61.45 R–61.45 M, 302.1–302.3, 52 R, 81 R, 329
See application file for complete search history.

(56) References Cited

U.S. PATENT DOCUMENTS 4,684,928 A * 8/1987 Takahashi et al. ..... 340/521
5,050,634 A * 9/1991 Fiechtner ..... 137/486
5,053,588 A * 10/1991 Bolender ..... 200/61.45 R
5,892,193 A * 4/1999 Norton ..... 200/61.53
6,086,572 A * 7/2000 Johnson et al. ..... 604/503
6,555,772 B1 4/2003 Chou
6,559,767 B2 5/2003 Huang
6,706,979 B1 3/2004 Chou
6,740,867 B2 5/2004 Chou
7,034,672 B2 * 4/2006 Dinello et al. ..... 340/447
7,127,137 B2 10/2006 Bowers et al.
7,566,839 B2 * 7/2009 Hukuba et al. ..... 200/61.45 R
2003/0020605 A1 * 1/2003 Starkey ..... 340/447
2005/0046529 A1 * 3/2005 Jao ..... 335/205
2006/0244439 A1 * 11/2006 Fukuoka et al. ..... 324/207.2

* cited by examiner

*Primary Examiner*—Michael A Friedhofer
(74) *Attorney, Agent, or Firm*—Phillips Lytle LLP

(57) ABSTRACT

A switch including a sealed housing; a magnetic sensor; and a control element configured to modify a control parameter for the switch in response to a signal from the sensor. In some aspects, the magnetic sensor is arranged to produce the signal in response to a magnetic field generated outside of the housing. In some aspects, the switch is a vibration switch, or is selected from the group consisting of a flow switch, a level switch, a temperature switch, a pressure switch, a proximity switch, and a velocity switch. In some aspects, the switch includes a two-wire configuration and first and second output pins arranged to provide an output signal for the switch and to receive a signal for programming the switch. In some aspects, the switch includes a two-wire configuration and a current-control element arranged to reduce current output for the switch.

29 Claims, 9 Drawing Sheets

SEALED CONTROL DEVICE WITH MAGNETICALLY ADJUSTABLE CONTROL PARAMETER

CROSS-REFERENCE TO RELATED APPLICATIONS

This application claims the benefit under 35 U.S.C. §119 (e) of U.S. Provisional Application No. 60/771,407 filed Feb. 8, 2006.

FIELD OF THE INVENTION

The invention relates generally to sensing control devices. In particular, the invention relates to two-wire devices or switches with sealed housings, magnetic sensing, or current limiting. In particular, the invention relates to a sealed two-wire vibration switch with a magnetically adjustable threshold.

BACKGROUND OF THE INVENTION

Machinery and mechanical systems face potential failure when the ability of the machinery or systems to function normally is compromised due to worn components or an upset in normal operating conditions. If a worn component or process upset can be detected, then operator warning or immediate shutdown can safeguard the machinery from catastrophic failure. It is known that machinery vibration increases when problems such as worn bearings, cracked gears, lack of or contamination of lubrication, imbalance, looseness, and misalignment become worse. It is also known to measure such vibrations to detect problems such problems. For example, an increase in measured machinery vibration is used to detect worn components or process upsets and to trigger alarms or shutdowns. For such applications, it is known to use a vibration switch to detect a vibration increase and trigger an alarm or shut down sequence. A vibration switch can also be used to alert an operator of a decrease in vibration levels, as may be the case when a motor ceases to function.

It is known to use an electronic vibration switch to monitor a conditioned electrical signal from a built-in, or remotely located; vibration sensor. This arrangement typically uses a three-wire configuration. The switch mechanism itself is a circuit board with a mechanical relay that is typically housed in an electronics enclosure. The circuitry monitors vibration signals from the sensor and compares the signals with a pre-set threshold value. When the signal exceeds (or decreases below in some cases) the threshold, the switch activates the relay. Unfortunately, such devices are bulky, limiting the applications for which the devices can be used. For example, the devices are not usable upon smaller equipment. Further, the devices have a limited range, require a separate power source (three wire) and individual wiring to the respective programmable logic controller (PLC) or alarming device. For those devices that must be sealed, for example, for use in hazardous or wet environments, internal adjustments, for example, of the threshold value, are not possible. On the other hand, those devices that have internal adjustments may not be usable in hazardous or wet environments due to the lack of a properly sealed housing.

Thus, there is a long-felt need to provide a vibration switch that is less bulky, has a greater range, does not require a separate power source, has on-board intelligence, can be sealed, and is configured for internal adjustments.

SUMMARY OF THE INVENTION

The invention broadly comprises a switch, including a sealed housing and a two-wire configuration. In some aspects, the switch includes first and second output pins arranged to provide an output signal for the switch and to receive a signal for programming the switch. In some aspects, the switch is a vibration switch, or is selected from the group including a flow switch, a level switch, a temperature switch, a pressure switch, a proximity switch, and a velocity switch. In some aspects, the switch includes a magnetic sensor and a control element configured to modify a control parameter in response to a signal from the sensor and the magnetic sensor is arranged to produce the signal in response to a magnetic field generated outside of the device. In some aspects, the switch includes a current-control element arranged to reduce current output for the switch.

The invention also broadly comprises a switch, including a sealed housing; a magnetic sensor; and a control element configured to modify a control parameter for the switch in response to a signal from the sensor. In some aspects, the magnetic sensor is arranged to produce the signal in response to a magnetic field generated outside of the housing. In some aspects, the switch is a vibration switch, or is selected from the group consisting of a flow switch, a level switch, a temperature switch, a pressure switch, a proximity switch, and a velocity switch. In some aspects, the switch includes a two-wire configuration and first and second output pins arranged to provide an output signal for the switch and to receive a signal for programming the switch. In some aspects, the switch includes a two-wire configuration and a current-control element arranged to reduce current output for the switch.

The invention further broadly comprises a two-wire control device including a magnetic sensor and a control element configured to modify a control parameter in response to a signal from the sensor. In some aspects, the magnetic sensor is arranged to produce the signal in response to a magnetic field generated outside of the device. In some aspects, the two-wire control device includes a switch. In some aspects, the switch is a vibration switch or is selected from the group consisting of a flow switch, a level switch, a temperature switch, a pressure switch, a proximity switch, and a velocity switch. In some aspects, the switch includes a sealed housing. In some aspects, the device includes first and second output pins arranged to provide an output signal for the switch and to receive a signal for programming the switch. In some aspects, the device includes a current-control element arranged to reduce current output for the device.

The invention still further broadly comprises a control device including a sealed housing; a magnetic sensor; and a control element configured to modify a control parameter in response to a signal from the sensor. In some aspects, the device includes a two-wire configuration. In some aspects, the device is a switch. In some aspects, the switch is selected from the group consisting of a vibration switch, a flow switch, a level switch, a temperature switch, a pressure switch, a proximity switch, and a velocity switch. In some aspects, the device includes a two-wire configuration and first and second output pins arranged to provide an output signal for the device and to receive a signal for programming the device. In some aspects, the device includes a two-wire configuration and a current-control element arranged to reduce current output for the device.

The invention broadly comprises a two-wire switch including a housing and a current-control element arranged to reduce current output for the switch. In some aspects, the switch includes a sealed housing. In some aspects, the two-wire control device is a switch. In some aspects, the switch is selected from the group consisting of a vibration switch, a flow switch, a level switch, a temperature switch, a pressure switch, a proximity switch, and a velocity switch. In some aspects, the switch includes first and second output pins arranged to provide an output signal for the switch and to receive a signal for programming the switch. In some aspects, the switch includes a magnetic sensor and a control element configured to modify a control parameter in response to a signal from the sensor.

It is a general object of the present invention to provide a sealed two-wire switch.

It is another object of the present invention to provide a magnetically adjustable sealed switch.

It is still another object of the present invention to provide a two-wire control device that is magnetically adjustable.

It is yet another object of the present invention to provide a sealed control device that is magnetically adjustable.

It is a further object of the present invention to provide a two-wire control device with a current adjustment to ensure proper drop-out of a connected relay.

These and other objects and advantages of the present invention will be readily appreciable from the following description of preferred embodiments of the invention and from the accompanying drawings and claims.

DETAILED DESCRIPTION OF THE PREFERRED EMBODIMENT

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
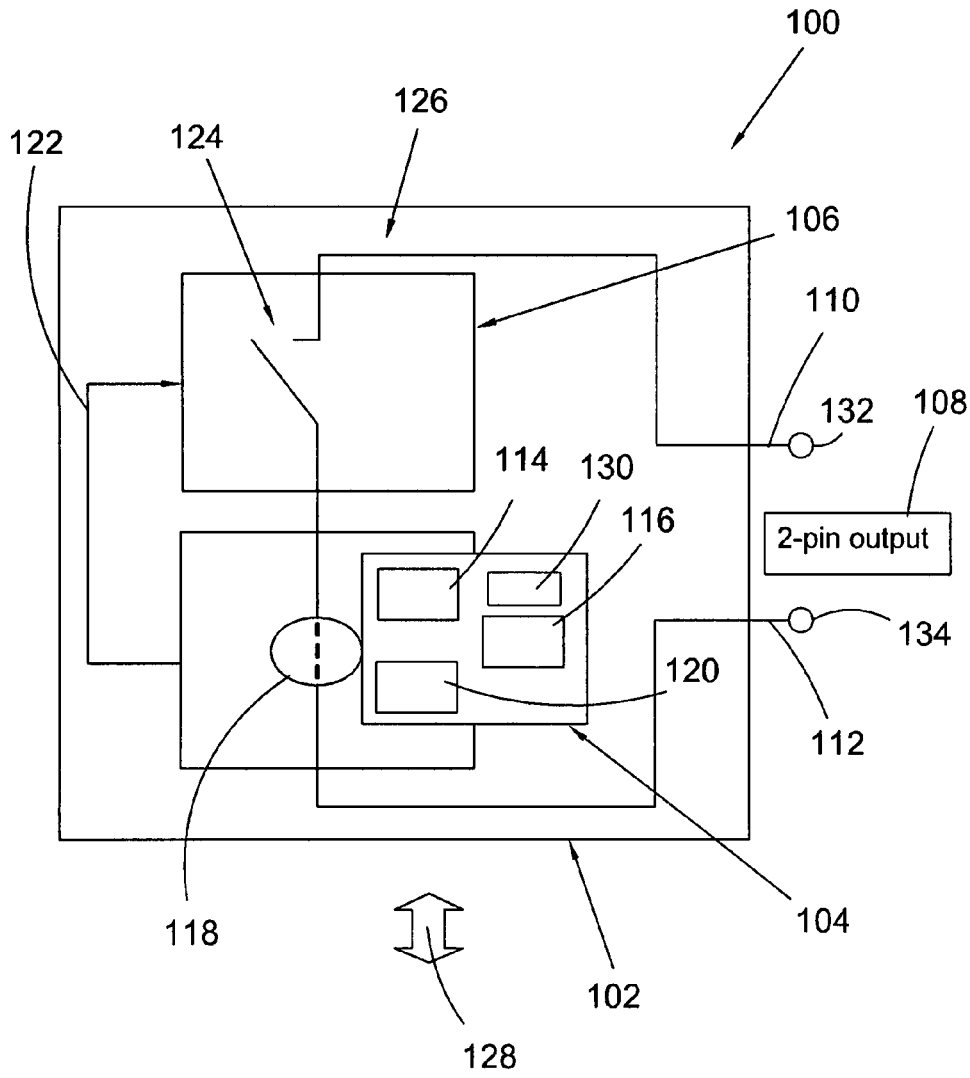
FIG. 1 is a block diagram of a present invention vibration switch.

FIG. 1 is a block diagram of present invention switch 100. Switch 100 includes sealed housing 102, control element 104, and switch 106. 2-pin output 108 is connected with wires 110 and 112. Element 104 and switch 106 are contained within housing 102. The housing is sealed using any means known in the art, including, but not limited to hermetic sealing. The housing can be constructed of any material known in the art, including, but not limited to, stainless steel. In some aspects, output 108 is an MIL type electrical connector.

In some aspects, element 104 includes signal conditioning electronics 114 and microprocessor 116. Power to switch 100 is supplied by a power source associated with a load (not shown). Any devices known in the art and meeting the requirements described herein can be used for 114 and 116. In some aspects, switch 106 is a solid-state switch with a 500 mA current capacity. In some aspects, solid-state switch 106 is advantageously small in size, for example, with a height of about 2.75 inches and a hex diameter of about 1.25 inches. In some aspects, the switch is advantageously light-weight, for example, about 7 ounces. The small size and weight offer excellent frequency response and low cross axis sensitivity as compared with bulkier known devices.

Switch 100 operates over wires 110 and 112. Switch 100 is installed in series with a load (not shown) and with a power supply for the load, forms a loop. The load can be any type known in the art, including, but not limited to an alarm or a shutdown device, such as a programmable logic controller (PLC), annunciator, or relay coil. Power to element 104 is supplied by any means known in the art, for example, from power interface 118 and wire 112. Parameter element 120 is used to identify the presence or characteristic of a particular parameter being monitored by switch 100, generates a signal regarding the parameter, and transmits the signal to the microprocessor. In response to a predetermined characteristic of the signal, microprocessor 116 activates switch 106 on line 122. In response, contacts 124 close, completing power circuit 126 and energizing output 108. The load connected to output 108 receives a power signal to facilitate a desired operation, such as an alarm or shutdown.

In some aspects, switch 100 is a vibration switch and element 120 is any vibration detection device known in the art, for example, a piezoelectric accelerometer. Element 120 senses vibration 128 impinging on housing 102, generates a signal proportional to the vibration, and transmits the signal to the microprocessor. When the signal exceeds a pre-determined threshold, microprocessor 116 activates switch 106 on line 122. It should be understood that sealed switch 100 can be any type of switch known in the art, including, but not limited to a flow, level, temperature, pressure, proximity, or velocity switch.

In some aspects, control element 104 includes current-control element 130 arranged to reduce current output for switch 100. Current-control is further described infra. In some aspects, output pins 132 and 134 are arranged to receive a signal for programming the switch, in particular element 104 and microprocessor 116. For such programming, for example, current or voltage modulation on output pins 132 and 134 could be used.

Figure 2:
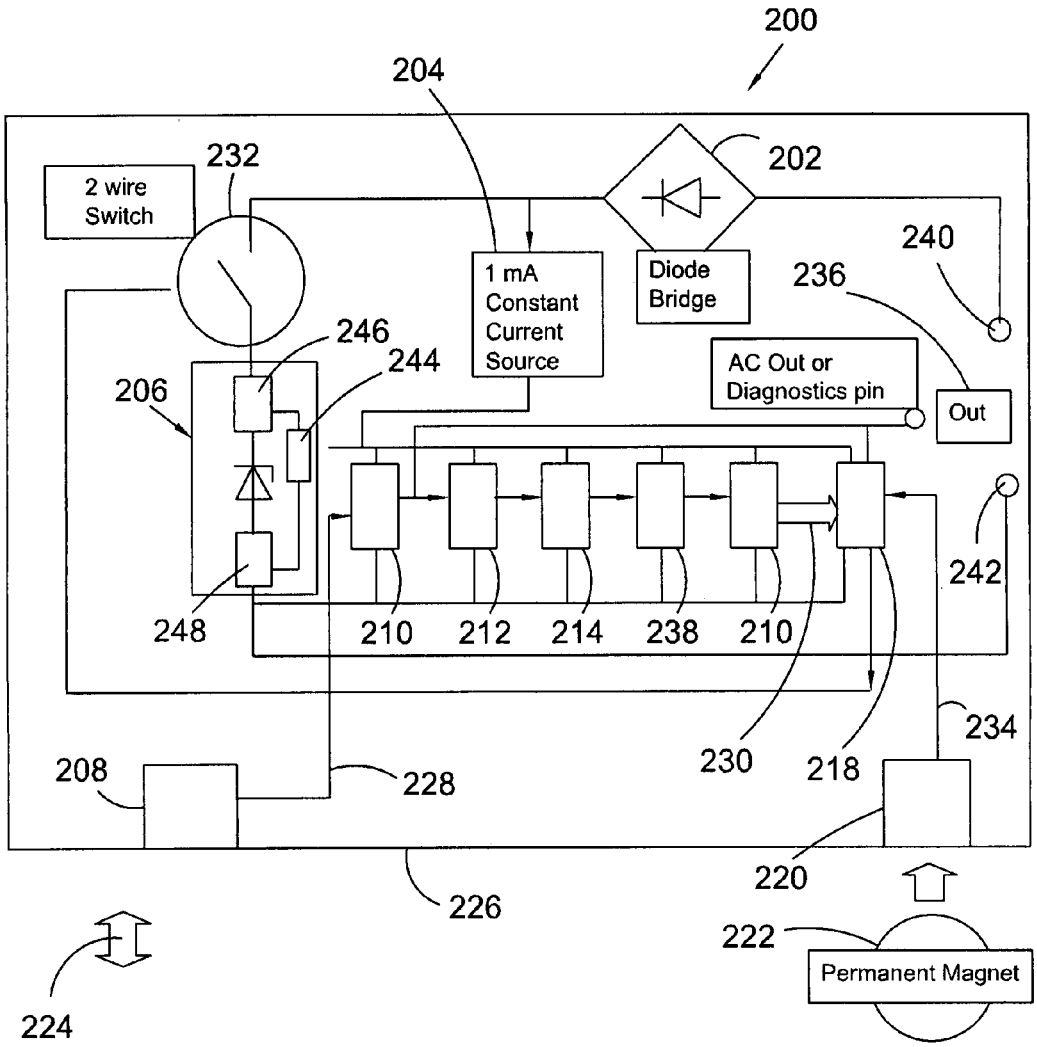
FIG. 2 is a functional block diagram of a present invention vibration switch.

FIG. 2 is a functional block diagram of present invention switch 200. In general, the discussion of switch 100 in the description of FIG. 1 is applicable to switch 200. For example, the discussion of the power arrangement for switch 100 is applicable to switch 200. Diode bridge 202 enables operation with AC voltages as well as positive or negative polarity DC voltages. Constant current source 204 and current-limiting element 206 offer further power conditioning to provide the stable voltage required for internal electronics. In some aspects, element 206 is a Zener diode circuit. The operation of the Zener diode circuit is further described infra. Switch 200 also includes parameter sensor 208, conditioning amplifier 210, filter 212, integrator 214, analog to digital converter 216, and microprocessor 218. In some aspects, magnetic sensor 220 is included. Sensor 220 enables user adjustment of a threshold value through magnet 222 and is described infra. Any devices known in the art can be used for sensor 208, conditioning amplifier 210, filter 212, integrator 214, analog to digital converter 216, and microprocessor 218. It also should be understood that the present invention is not limited to the configuration shown and that other configurations and parameter values are included in the spirit and scope of the invention as claimed.

In some applications, switch 200 is a vibration switch and sensor 208 is a vibration sensor, for example, an accelerometer. It should be understood that any vibration sensor known in art can be used. In some aspects, vibration switch 200 can be installed by screwing into a tapped mounting hole on the surface of machinery (not shown). During operation of the machinery, vibration 224 is generated and impinges on housing 226 and vibration sensor 208 detects the vibration and generates an analog signal on line 228 proportional to the acceleration of the vibration present at the installed location. The signal on line 228 is amplified, filtered, integrated (to velocity), and digitized to form signal 230, which is interrogated by the microprocessor. Microprocessor 218 operates on signal 230, for example, in some aspects, the microprocessor compares a root mean square velocity signal against a programmed threshold value and activates switch 232 when the velocity signal attains a predetermined relationship with the threshold, for example, exceeds the threshold. It should be understood that any means known in the art can be used to process and evaluate the signal from sensor 208 and that any processing and evaluation known in the art can be performed on the signal from sensor 208.

In general, the programmed threshold value is the upper limit of acceptable vibration for a specific machine operating within a particular application. The threshold value may vary for dissimilar machines or for identical machines operating under different conditions. It should be understood that the present invention is not limited to any particular threshold value. In some cases, the threshold value is known and fixed. Then, vibration switch 200 can be configured with a fixed threshold value. That is, the threshold value can be preset in the switch and adjustment of the threshold is not necessary. In other cases, the threshold value is not known or is variable, necessitating the ability to adjust the threshold value, in particular, in the field. Sensor 220 and magnet 222 are used to adjust the threshold as described infra. The use of the sensor and magnet provide an effective and easy way to change and set the threshold value at any location.

Sensor 220 is activated by touching housing 226 proximate the sensor with a magnetic device, for example, permanent magnet 222. It should be understood that the invention is not limited to use with permanent magnets and that any magnetic device known in the art can be used. The sensitivity of sensor 220 and the strength of magnet 222 can be selected to prevent spurious readings, for example, due to ambient electro-magnetic energy. For example, in some aspects, sensor 220 has a sensitivity of approximately one tesla (T) and the magnet 222 has a strength of approximately two to three T at a distance of approximately 0.5 inches. It should be understood that other combinations and configurations of sensor sensitivity and magnet strength are included in the spirit and scope of the claimed invention.

Sensor 220 generates a signal on line 234 to initiate a process within the microprocessor to change the threshold value. In some aspects, the threshold adjustment includes averaging the vibration experienced by the switch 200 over a fixed sample period of, for example, approximately 30 seconds. The average vibration value is then multiplied by a value, for example, two. The new value (two×average vibration value) becomes the new threshold value. This process is entirely automatic and requires no additional calibration devices or instrumentation. It should be understood that the present invention is not limited to straight averaging or to the time periods or multiplication value noted above and that other mathematical operations, time periods, and values are included within the spirit and scope of the invention as claimed. In some aspects, to achieve a more precise set-up of the threshold value, vibration switch 200 can be mounted to a controlled vibration shaker (not shown) to experience a more controllable and measurable vibration amplitude for use as a baseline in setting the threshold.

In some aspects, switch 200 operates to confirm that the threshold value has been accepted by the microprocessor. For example, the microprocessor can open and close switch 232, for example, in a pattern, or switch 200 can vary the current from output 236. The current variation can be detected with a meter or any other means known in the art. The present invention is not limited to any particular pattern for cycling switch 232. In some aspects (not shown), switch 200 includes a visual annunciator, such as a light source, in particular an LED, that is energized or de-energized with respect to the setting of the threshold. For example, the light source can be made to blink (cycled on and off) when the threshold is established. It should be understood that the present invention is not limited to any particular light source and that any light source known in the art can be used. Further, the present invention is not limited to a particular pattern or combination of excitation or de-excitation of the light source.

In some aspects additional switch parameters besides the threshold level can be activated or modified. These parameters include, but are not limited to latching or not latching mode, normally open or normally closed mode, or operating delay. In some aspects, switch parameters are known in advance for a particular application and the parameters are specified and factory adjustable. In some aspects, switch parameters are field programmable in processor 218 through switch operating pins 236. In some aspects, the protocol used to field program the processor is the same as the HART protocol technology used for loop powered two wire transmitters. In some aspects, output pins 240 and 242 are arranged to receive a signal for programming the switch, in particular microprocessor 218.

In some aspects, Zener diode circuit 206 includes pins 244, 246, and 248. Pin 244 provides constant voltage for electronics, such as microprocessor 218. Normally pins 246 and 248 are shorted. During the time periods when the current on pin 240 is to be limited, as explained infra, pin 248 is disconnected and voltage for the electronics is provided by internal capacitance (not shown) for pin 244. The capacitance is charged prior to disconnecting 248.

It should be understood that switch 200 can be any type of switch known in the art, including, but not limited to a flow, level, temperature, pressure, proximity, or velocity switch. The type, location, operation, and configuration of element 208 are determined in accordance with the type for switch 200. For example, if switch 200 is a pressure switch, element 208 can be a pressure transducer and signal 230 is regarding a pressure sensed by the transducer.

Figure 3:
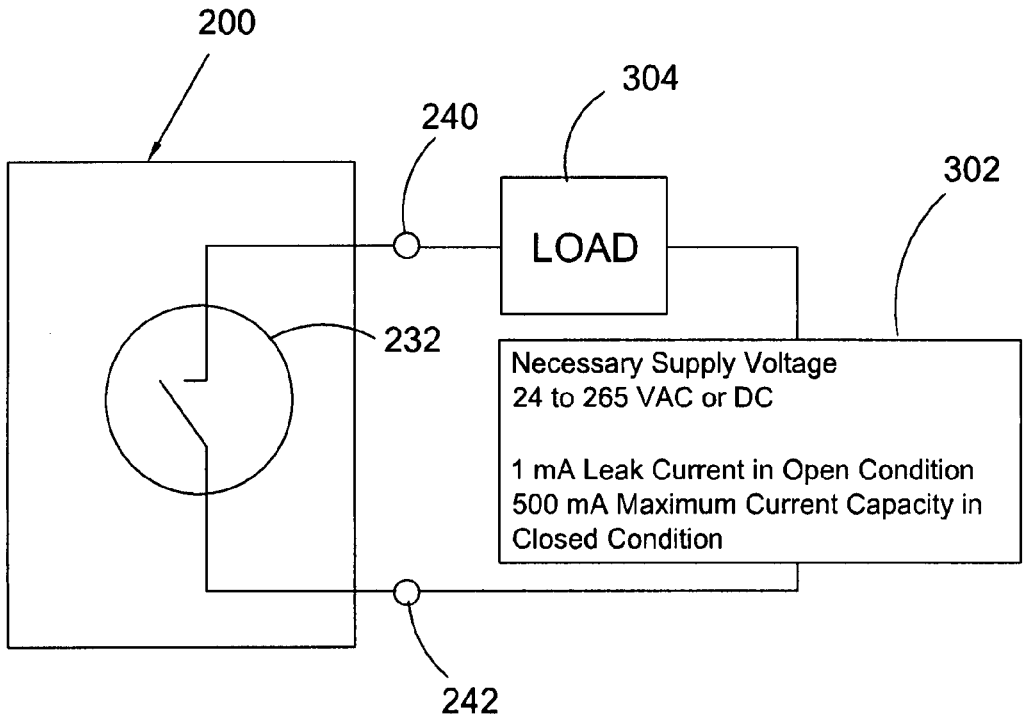
FIG. 3 is a block diagram of a present invention vibration switch application.

FIG. 3 is a block diagram of a present invention switch application, for example, a vibration switch application. As described supra, the excitation power for vibration switch 200 is associated with a connected load, for example, power supply 302 and load 304. This arrangement restricts the amount of current passing through the switch. In some aspects, the current is limited to 500 mA. However, it should be understood that the present invention is not limited to a particular maximum current value.

Figure 4A:
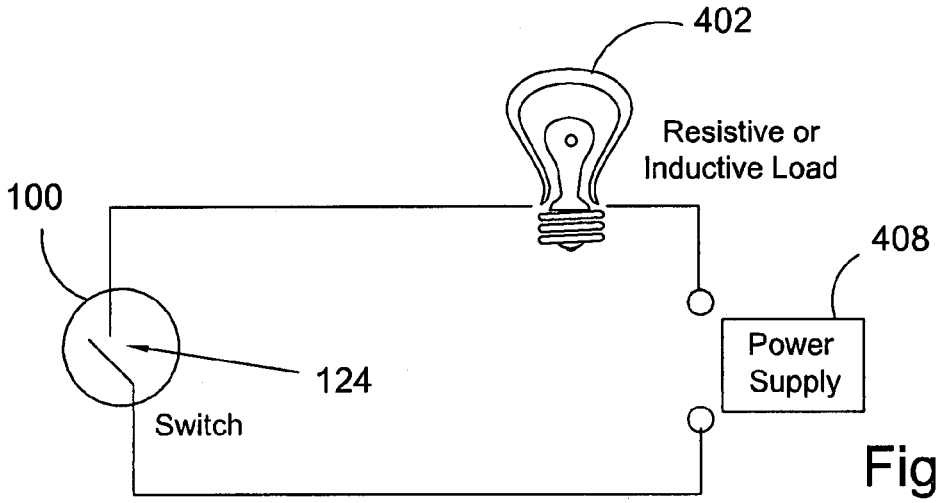
FIGS. 4A through 4C are block diagrams of other examples of present invention vibration switch applications.
Figure 4B:
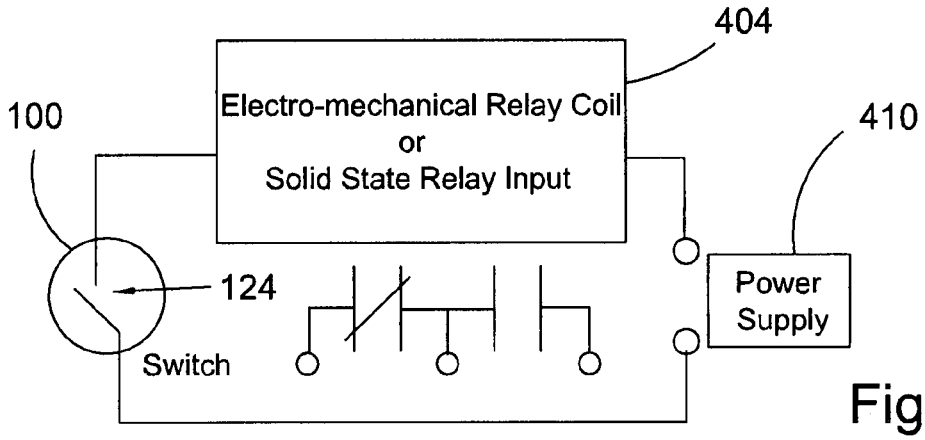
Figure 4C:
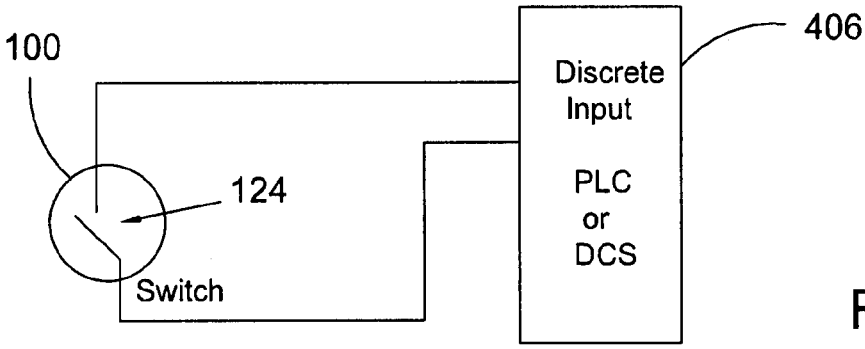

FIGS. 4A through 4C are block diagrams of other examples of present invention vibration switch applications. In FIGS. 4A through 4C, switch 100 is connected to loads 402, 404, 406, respectively. In the figures, the representation of switch 100 has been greatly simplified to facilitate the discussion, specifically, only contact 124 is shown inside the switch. Loads 402 and 404 are shown with associated power supplies 408 and 410. The power supply for load 406 is on-board 406 and not shown. In general, the power requirements for present invention switch 100 are very broad, enabling the use of the switch with virtually any type of load known in the art, including, but not limited to a PLC, annunciator lamp, alarm device, electromechanical relay, or solid-state relay. In some aspects, the switch can be powered by a range from 24 to 265 V, AC or DC. However, it should be understood that other ranges are possible. In some aspects, with switch 100 in an open condition (contacts 124 open) there is a leak current of approximately 1 mA. In some aspects, in the closed condition (contacts 124 closed), the switch supports a current of up to 500 mA with a voltage drop of approximately 8 V. However, it should be understood that other current ranges and voltage drops are included. For example, in some aspects, switch 100 operates from 10 to 30 VDC, and possesses a voltage drop, in the closed condition, of 1.5 VDC. FIGS. 4A through 4C illustrate resistive or inductive loads, electro-mechanical relay coil or solid state relay input loads, and discrete inputs, respectively. However, it should be understood that the preceding are non-limiting examples, and that the present invention can be used in applications involving other loads known in the art.

Figure 5:
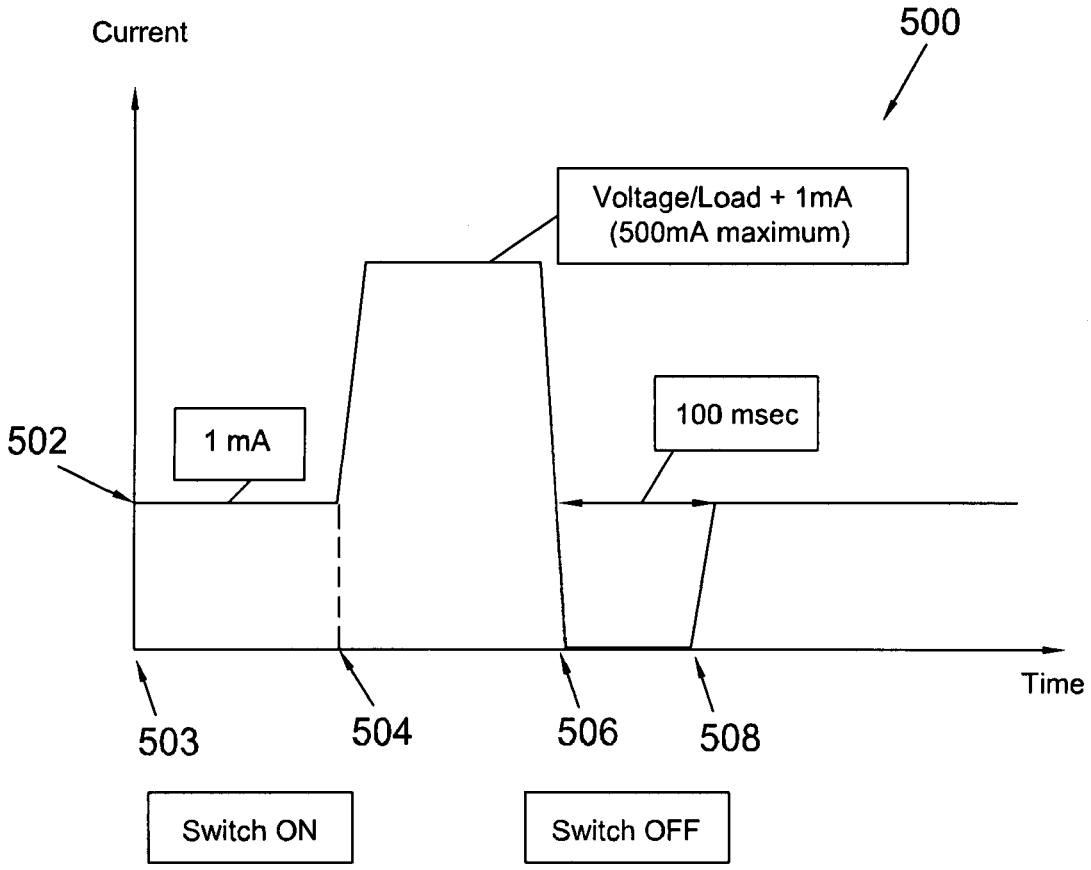
FIG. 5 is a current versus time graph illustrating drop out with respect to a present invention vibration switch.

FIG. 5 shows current versus time graph 500 illustrating drop out with respect to a present invention vibration switch. Graph 500 is a graph of current into a relay coil (load) versus time. In some aspects, a present invention switch, for example as shown in FIGS. 1 and 2, is configured to accentuate compatibility with electromechanical relays (not shown), which are a popular choice for use in machinery shutdown and alarm applications. Electromechanical relays operate with a drop-out current smaller than their pickup current. Therefore, to ensure successful dropout of a load relay when a present invention vibration switch returns to an open state, the vibration switch reduces current output below a selected level, for example, the leakage current level, for a predetermined length of time, as shown in FIG. 5. During this period of time, the current on the output leads for the switch drops well below the drop out current level for the relay, enabling proper dropout of the electromechanical relay. In some aspects, the current output for the switch drops to virtually zero.

For example, current level 502 represents a leakage current value for a present invention switch. From time 503 to approximately time 504, the switch is off and the coil senses the leakage current from the switch. The switch is on from just after time 504 and is turned off again at approximately time 506. To ensure that the current level is sufficiently low to drop the relay coil out, from just after time 506 to approximately time 508, the current output from the switch is reduced to zero. After time 508, the output of the switch becomes equal to the leakage current for the switch. In some aspects, the time period from 506 to 508 is 100 ms, however, it should be understood that the present invention is not limited to this time period and that other time periods are within the spirit and scope of the invention as claimed. In some aspects, the leakage current for a present invention switch is 1 mA, which is significantly and advantageously lower than the pickup current for most electromechanical relays, enhancing the compatibility of a present invention switch with a wide variety of known relays.

Returning to FIG. 2, in some aspects, the above-described current control is implemented by element 206, for example, Zener diode circuit 206. As noted supra; pin 244 provides constant voltage for electronics, such as microprocessor 218. Normally pins 246 and 248 are shorted. During the time period between 506 and 508, the time period when the output current of switch 200 is reduced to ensure drop-out, pin 248 is disconnected and voltage for the electronics is provided by internal capacitance (not shown) for pin 244. The capacitance is charged prior to disconnecting 248.

It should be understood that the present invention output current adjustment discussed in the description for FIG. 5 is applicable to any two-wire switch. Examples of such devices include, but are not limited to switches to measure flow, level, temperature, pressure, proximity, or velocity. That is, the functionality shown in FIG. 2 can be included in these other switches to implement the output current adjustment.

Figure 6:
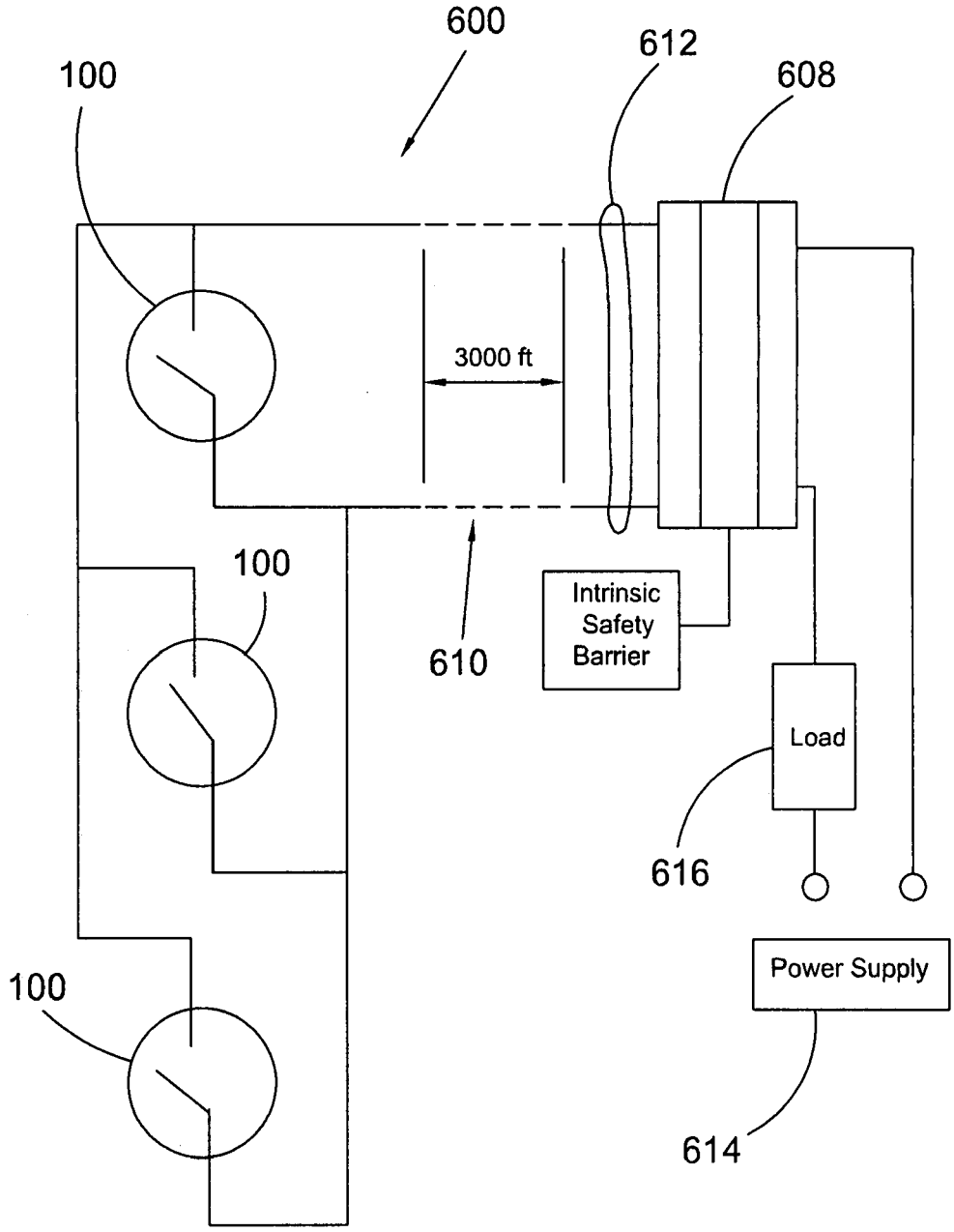
FIG. 6 is a block diagram illustrating a parallel application of present invention vibration switches.

FIG. 6 is a block diagram illustrating a parallel application 600 of present invention switches 100. In many applications, a plurality of loads such as motors or pumps operate for a common process in close proximity to each other. Present invention switches can be installed in parallel for such configurations of loads, as shown in FIG. 6. A parallel configuration of switches offers several benefits including reduced installation costs, since multiple switches can be connected to a single, two-wire cable that is routed to the control area and, for hazardous areas, only one protection barrier, for example, barrier 608, is needed. With a parallel arrangement, one load element can cause a common alarm to be annunciated, can initiate the shutdown of all or selected loads, or can alarm and initiate shutdown simultaneously. The present invention is not limited to use with any particular combination or configuration of parallel loads.

FIG. 6 also illustrates the long distances possible between present invention switches and their connected loads. In general, a two-wire configuration enables a control/sensing device to be placed further from a load and its associated power supply than is possible with other configurations, such as a three-wire configuration. For example, distance 610 is shown as 3,000 feet. However, it should be understood that other distances, some greater than 3,000 feet are possible using the present invention. Distance 610 is at least partially dependent on the gauge of wire 612 used and the characteristics of the power supply associated with the load, for example, power supply 614 associated with load 616.

Present invention vibration switches present a simple and effective means of protecting loads against damage or failure associated with undesired vibration levels. For example, returning to FIGS. 2 and 3 and those aspects in which switch 200 is a vibration switch, load 304 can be left running, switch 200 can be installed to the load, and the threshold for switch 200 can be set using a magnet, for example, magnet 222. Then, after the sample period described supra in the description of FIG. 2, a threshold value referenced to the vibrations of load 304 as it is operating during the sampling period is established for switch 200. For example, as discussed in the description of FIG. 2, the threshold could be twice the average vibration of the load during the sample period. Present invention switches are compatible with any loads known in the art, such as a relay, monitoring system, or control device.

Figure 7:
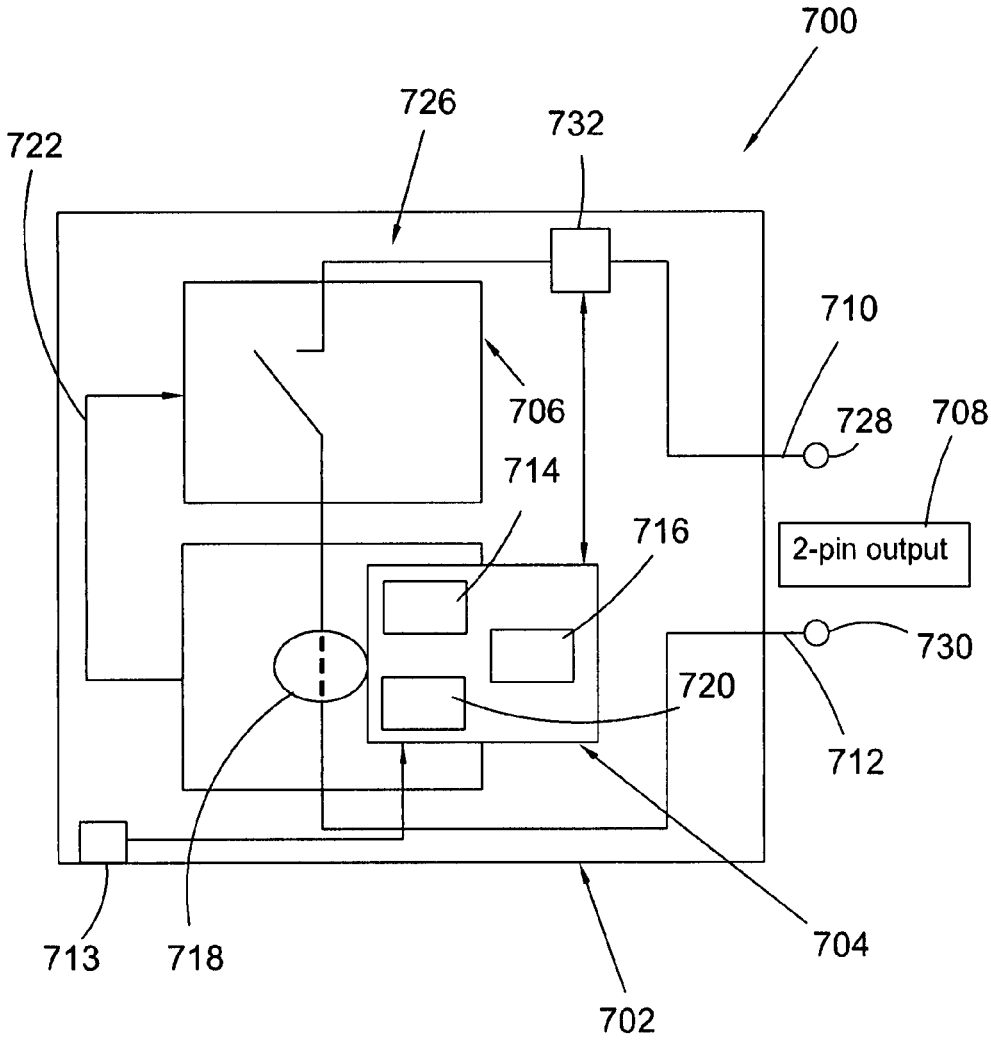
FIG. 7 is a block diagram illustrating a present invention magnetically adjustable two-wire control device.

FIG. 7 is a block diagram illustrating present invention magnetically adjustable two-wire control device 700. The present invention magnetic adjustment discussed for switch 200 in the description for FIG. 2 also is applicable to two-wire control devices in general. Device 700 includes housing 702, control element 704, and control output element 706. 2-pin output 708 is connected with wires 710 and 712. Element 704 and element 706 are contained within housing 702. In some aspects, output 708 is an MIL type electrical connector. Device 700 also includes magnetic sensor 713 connected to control element 704. The discussion regarding sensor 220 in FIG. 2 is applicable to sensor 713 and the general discussion regarding magnet adjustability for switch 200 is applicable to device 700.

In some aspects, element 704 includes signal conditioning electronics 714 and microprocessor 716. Power to device 700 is supplied by a power source associated with a load (not shown). Any devices known in the art and meeting the requirements described herein can be used for 714 and 716.

Device 700 operates over wires 710 and 712. Device 700 is installed in series with a load (not shown) and with a power supply for the load, forms a loop. The load can be any type known in the art, including, but not limited to an alarm or a shutdown device, such as a programmable logic controller (PLC), annunciator, or relay coil. Power to element 704 is supplied by any means known in the art, for example, from power interface 718 and wire 712. Parameter element 720 is used to identify the presence or characteristic of a particular parameter being monitored by device 700, generates a signal regarding the parameter, and transmits the signal to the microprocessor. In response to a predetermined characteristic of the signal, microprocessor 716 activates element 706 on line 722. In response, the microprocessor and/or element 706 output a control signal on circuit 726 to output 708. The load connected to output 708 receives the control signal and responds accordingly.

In some aspects, device 700 is a switch device, element 706 is a switch, and the discussion of switches 100 and 200 in FIGS. 1 and 2, respectively, is applicable to device 700. In some aspects, housing 702 is sealed and the discussion of housing 102 in FIG. 1 is applicable to housing 702. In some aspects, device 700 is a switch and is programmable over pins 728 and 730. In some aspects, device 700 is a switch and includes current-control element 732 arranged to reduce current output for device 700. The discussion regarding element 206 for switch 200 in FIG. 2 is applicable to element 732. It should be understood that device 700 is not limited to the configuration of components shown.

Figure 8:
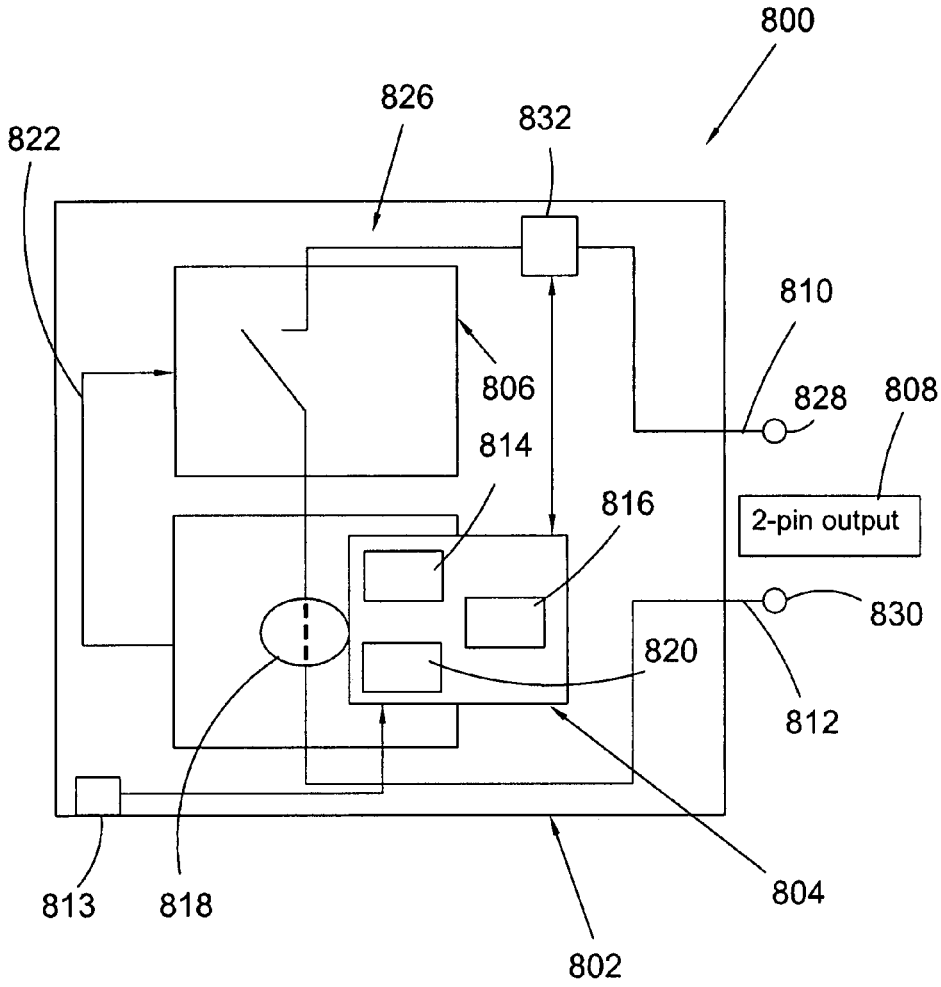
FIG. 8 is a block diagram illustrating a present invention sealed and magnetically adjustable two-wire control device; and, FIG. 9 is a block diagram illustrating a present invention two-wire switch with current limiting.

FIG. 8 is a block diagram illustrating present invention sealed and magnetically adjustable two-wire control device 800. The present invention sealed housing discussed for switch 100 in the description for FIG. 1 and the magnetic adjustment discussed for switch 200 in the description for FIG. 2 also are applicable to two-wire control devices in general. Device 800 includes sealed housing 802, control element 804, and control output element 806. 2-pin output 808 is connected with wires 810 and 812. Element 804 and element 806 are contained within housing 802. The housing is sealed using any means known in the art, including, but not limited to hermetic sealing. The housing can be constructed of any material known in the art, including, but not limited to, stainless steel. Device 800 also includes magnetic sensor 813 connected to control element 804. The discussion regarding sensor 220 in FIG. 2 is applicable to sensor 813 and the general discussion regarding magnet adjustability for switch 200 is applicable to device 800.

In some aspects, element 804 includes signal conditioning electronics 814 and microprocessor 816. Power to device 800 is supplied by a power source associated with a load (not shown). Any devices known in the art and meeting the requirements described herein can be used for 814 and 816.

Device 800 operates over wires 810 and 812. Device 800 is installed in series with a load (not shown) and with a power supply for the load, forms a loop. The load can be any type known in the art, including, but not limited to an alarm or a shutdown device, such as a programmable logic controller (PLC), annunciator, or relay coil. Power to element 804 is supplied by any means known in the art, for example, from power interface 818 and wire 812. Parameter element 820 is used to identify the presence or characteristic of a particular parameter being monitored by device 800, generates a signal regarding the parameter, and transmits the signal to the microprocessor. In response to a predetermined characteristic of the signal, microprocessor 816 activates element 806 on line 822. In response, the microprocessor and/or element 806 output a control signal on circuit 826 to output 808. The load connected to output 808 receives the control signal and responds accordingly.

In some aspects, device 800 is a switch device, element 806 is a switch, and the discussion of switches 100 and 200 in FIGS. 1 and 2, respectively, is applicable to device 800. In some aspects, device 800 is a switch and includes a current-control element (not shown) arranged to reduce current output for device 800. In some aspects, device 800 is a switch and is programmable over pins 828 and 830. In some aspects, device 800 is a switch and includes current-control element 832 arranged to reduce current output for device 800. The discussion regarding element 206 for switch 200 in FIG. 2 is applicable to element 832. It should be understood that device 800 is not limited to the configuration of components shown.

Figure 9:
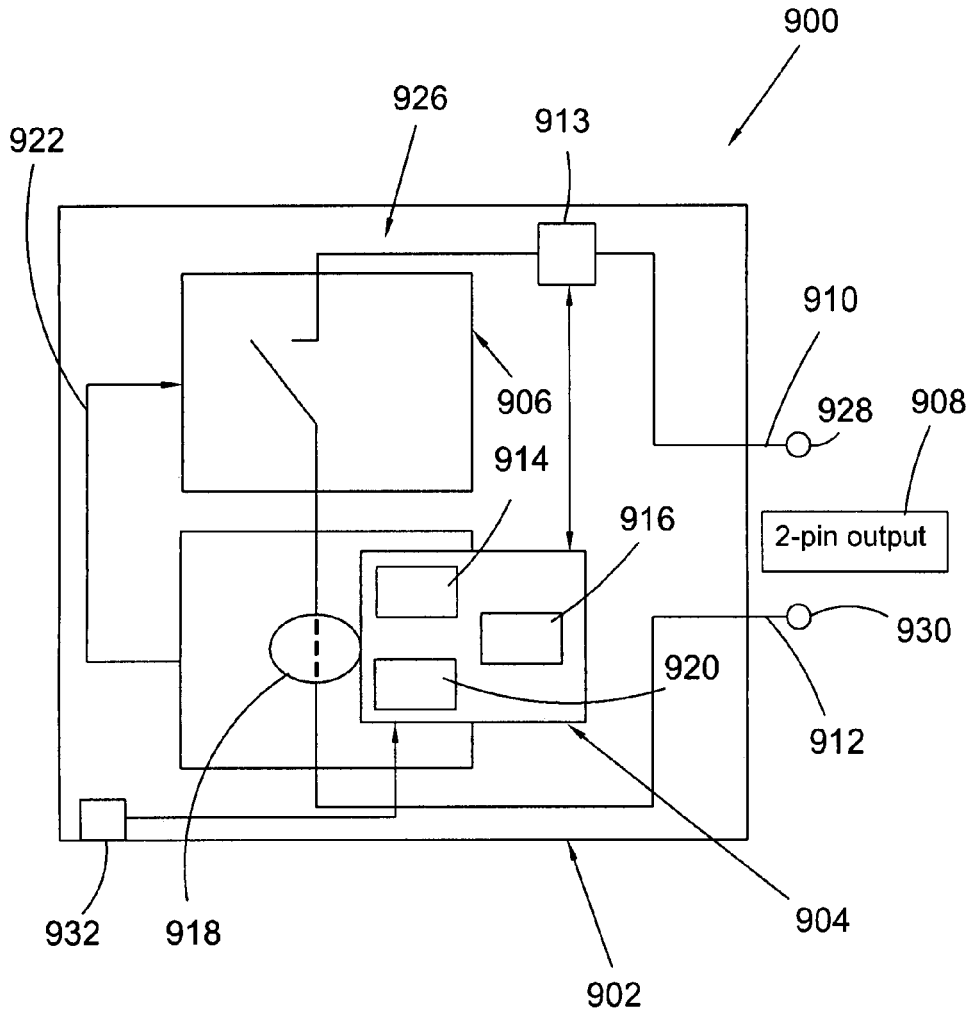

FIG. 9 is a block diagram illustrating present invention two-wire switch 900 with current limiting. Device 900 includes housing 902, control element 904, and control output element 906. 2-pin output 908 is connected with wires 910 and 912. Element 904 and element 906 are contained within housing 902.

Element 904 includes current-control element 913 arranged to reduce current output for device 900. The discussion regarding element 206 for switch 200 in FIG. 2 is applicable to element 913. In some aspects, element 904 includes signal conditioning electronics 914 and microprocessor 916. Power to device 900 is supplied by a power source associated with a load (not shown). Any devices known in the art and meeting the requirements described herein can be used for 914 and 916.

Device 900 operates over wires 910 and 912. Device 900 is installed in series with a load (not shown) and with a power supply for the load, forms a loop. The load can be any type known in the art, including, but not limited to an alarm or a shutdown device, such as a programmable logic controller (PLC), annunciator, or relay coil. Power to element 904 is supplied by any means known in the art, for example, from power interface 918 and wire 912. Parameter element 920 is used to identify the presence or characteristic of a particular parameter being monitored by device 900, generates a signal regarding the parameter, and transmits the signal to the microprocessor. In response to a predetermined characteristic of the signal, microprocessor 916 activates element 906 on line 922. In response, the microprocessor and/or element 906 output a control signal on circuit 926 to output 908. The load connected to output 908 receives the control signal and responds accordingly.

In some aspects, device 900 is a switch device, element 906 is a switch, and the discussion of switches 100 and 200 in FIGS. 1 and 2, respectively, is applicable to device 900. In some aspects, device 900 is a switch and is programmable over pins 928 and 930. In some aspects, housing 902 is sealed and the discussion of housing 102 in FIG. 1 is applicable to housing 902. In some aspects, Device 900 also includes magnetic sensor 932 connected to control element 904. The discussion regarding sensor 220 in FIG. 2 is applicable to sensor 932 and the general discussion regarding magnet adjustability for switch 200 is applicable to device 900. It should be understood that device 800 is not limited to the configuration of components shown.

Thus, it is seen that the objects of the invention are efficiently obtained, although changes and modifications to the invention should be readily apparent to those having ordinary skill in the art, without departing from the spirit or scope of the invention as claimed. Although the invention is described by reference to a specific preferred embodiment, it is clear that variations can be made without departing from the scope or spirit of the invention as claimed.

What is claimed is:

1. A vibration switch, comprising:

a first electrical contact and a second electrical contact;

a sealed housing containing:

a switch element arranged in series between said first electrical contact and said second electrical contact, said switch element having a first state with a first impedance and a second state with a second impedance which is different from said first impedance;

a vibration sensor with a vibration sensor output;

a memory element for holding a threshold parameter;

a magnetic sensor; and, a control element arranged to control the state of said switch element as a function of said vibration sensor output and said threshold parameter, wherein said threshold parameter is updated in response to a magnetic field selectively applied to said magnetic sensor.

2. The vibration switch of claim 1 wherein said control element is configured to receive a signal through said first electrical contract for updating said threshold parameter.

3. The vibration switch device of claim 2, wherein said signal further comprises a latching mode parameter, a default open-closed parameter, and an operating delay parameter.

4. The vibration switch device of claim 1, wherein said switch element first impedance is approximately an open circuit and said switch element second impedance is approximately zero.

5. The vibration switch device of claim 1, wherein said vibration sensor is an accelerometer, a piezoelectric accelerometer, a pressure sensor or a velocity sensor.

6. The vibration switch device of claim 1, wherein said control element further comprises conditioning electronics.

7. The vibration switch device of claim 6, wherein said conditioning electronics comprises an amplifier, a filter, and an integrator.

8. The vibration switch device of claim 1, further comprising a power interface configured to draw power from a source external to said sealed housing through said first electrical contact and said second electrical contact.

9. The vibration switch device of claim 8, wherein said source is the power source for a load placed in series with said vibration switch device.

10. The vibration switch device of claim 1, wherein an average of said vibration sensor output over a time duration is calculated and said threshold parameter is updated with a value about two times said average.

11. The vibration switch device of claim 1, further comprising a light source, wherein said light source is cycled on and off in an observable pattern when said threshold parameter is updated.

12. A vibration switch device comprising:

a first electrical contact and a second electrical contact;

a sealed housing containing:

a switch element arranged in series between said first electrical contact and said second electrical contact, said switch element having a first state with a first impedance and a second state with a second impedance which is different from said first impedance;

a vibration sensor with a vibration sensor output;

a power interface configured to draw power from a source external to said sealed housing through said first electrical contact and said second electrical contact;

a memory element for holding a threshold parameter;

a control element arranged to control the state of said switch element as a function of said vibration sensor output and said threshold parameter; wherein said control element is configured to update said threshold parameter in response to a signal received through said first electrical contact.

13. The vibration switch device of claim 12, wherein said signal further comprises a latching mode parameter, a default open-closed parameter, and an operating delay parameter.

14. A vibration switch comprising:

a first electrical contact and a second electrical contact;

a sealed housing containing:

a switch element arranged in series between said first electrical contact and said second electrical contact;

a vibration sensor with a vibration sensor output;

a memory element for holding a threshold parameter;

a control element having an under-threshold state wherein said control element causes said switch element to allow a first current to flow between said first electrical contact and said second electrical contact, an over-threshold state wherein said control element causes said switch element to have a low impedance, and a dropout state wherein said control element causes said switch element to allow a second current less than said first current to flow between said first electrical contact and said second electrical contact;

said control element configured to enter said over-threshold state when said vibration sensor output exceeds said threshold parameter;

said control element configured to change from said over-threshold state to said dropout state when said vibration sensor output is less than said threshold parameter; and said control element configured to change from said drop-out state to said under-threshold state when said vibration sensor output is continuously less than said threshold parameter for a desired time duration.

15. The vibration switch of claim 14, wherein said first electrical contact, said second electrical contact, and said control element are configured to receive a signal for updating said threshold parameter.

16. The vibration switch of claim 14 further comprising a magnetic sensor.

17. The vibration switch device of claim 14, wherein said vibration sensor output is an average calculated over a second desired time duration.

18. The vibration switch device of claim 14, wherein said first current is approximately 1 mA, said low impedance is approximately zero, and said second current is approximately zero.

19. The vibration switch device of claim 14, wherein said vibration sensor is an accelerometer, a piezoelectric accelerometer, a pressure sensor, or a velocity sensor.

20. The vibration switch device of claim 14, wherein said control element further comprises conditioning electronics.

21. The vibration switch device of claim 20, wherein said conditioning electronics comprises an amplifier, a filter, and an integrator.

22. The vibration switch device of claim 14, further comprising a power interface configured to draw power from a source to said sealed housing through said first electrical contact and said second electrical contact.

23. The vibration switch device of claim 22, wherein said source is a power source for a load placed in series with said vibration switch device.

24. The vibration switch device of claim 14, further comprising a magnetic sensor.

25. The vibration switch device of claim 24, further comprising a magnet, wherein said control element is configured to update said threshold parameter in response to a magnetic field applied to said magnetic sensor.

26. The vibration switch device of claim 25, wherein said threshold parameter is updated as a function of an average of said vibration sensor output over a third desired time duration, while said magnet is placed near said magnetic sensor.

27. The vibration switch device of claim 14, further comprising a light source, wherein said light source is cycled on and off in an observable pattern when said threshold pattern is updated.

28. The vibration switch device of claim 14, wherein said first electrical contact, said second electrical contact, and said control element are configured to receive a signal for updating said threshold parameter.

29. The vibration switch device of claim 28, wherein said signal further comprises a latching mode parameter, a default open-closed parameter, and an operating delay parameter.

* * * * *